United States Patent [19]

Zellmer

[11] 3,990,345

[45] Nov. 9, 1976

[54] INTERVALOMETER

[75] Inventor: Wayne G. Zellmer, China Lake, Calif.

[73] Assignee: The United States of America as represented by the Secretary of the Navy, Washington, D.C.

[22] Filed: June 24, 1974

[21] Appl. No.: 482,704

[52] U.S. Cl. ..... 89/1.814; 102/70.2 R

[51] Int. Cl.[2] ..... F41F 3/00

[58] Field of Search ..... 89/1.8, 1.814; 102/70.2 R; 317/80

[56] References Cited

UNITED STATES PATENTS

| | | | |
|---|---|---|---|
| 2,677,790 | 5/1954 | Arps | 102/21.6 |
| 3,202,227 | 8/1965 | Ezran | 89/1 C |
| 3,499,363 | 3/1970 | Lauro | 89/1.814 |
| 3,617,813 | 11/1971 | Everest | 89/1.814 |
| 3,700,971 | 10/1972 | Everest et al. | 89/1.814 |
| 3,768,408 | 10/1973 | Hallmark | 102/21.6 |

*Primary Examiner*—Stephen C. Bentley
*Assistant Examiner*—S. A. Cangialosi
*Attorney, Agent, or Firm*—R. S. Sciascia; Roy Miller

[57] ABSTRACT

An improved firing circuit for rocket launchers and the like which includes a normally open switch between the power source and the firing selector switch and an oscillating grounding switch. The grounding switch and the firing selector switch are simultaneously operated by a rotary solenoid or the like and are connected by a ratchet arrangement so that oscillatory motion of the grounding switch causes rotary motion of the firing selector switch. The normally open switch is closed to apply power through the selector switch only near the end of each increment of rotation.

7 Claims, 1 Drawing Figure

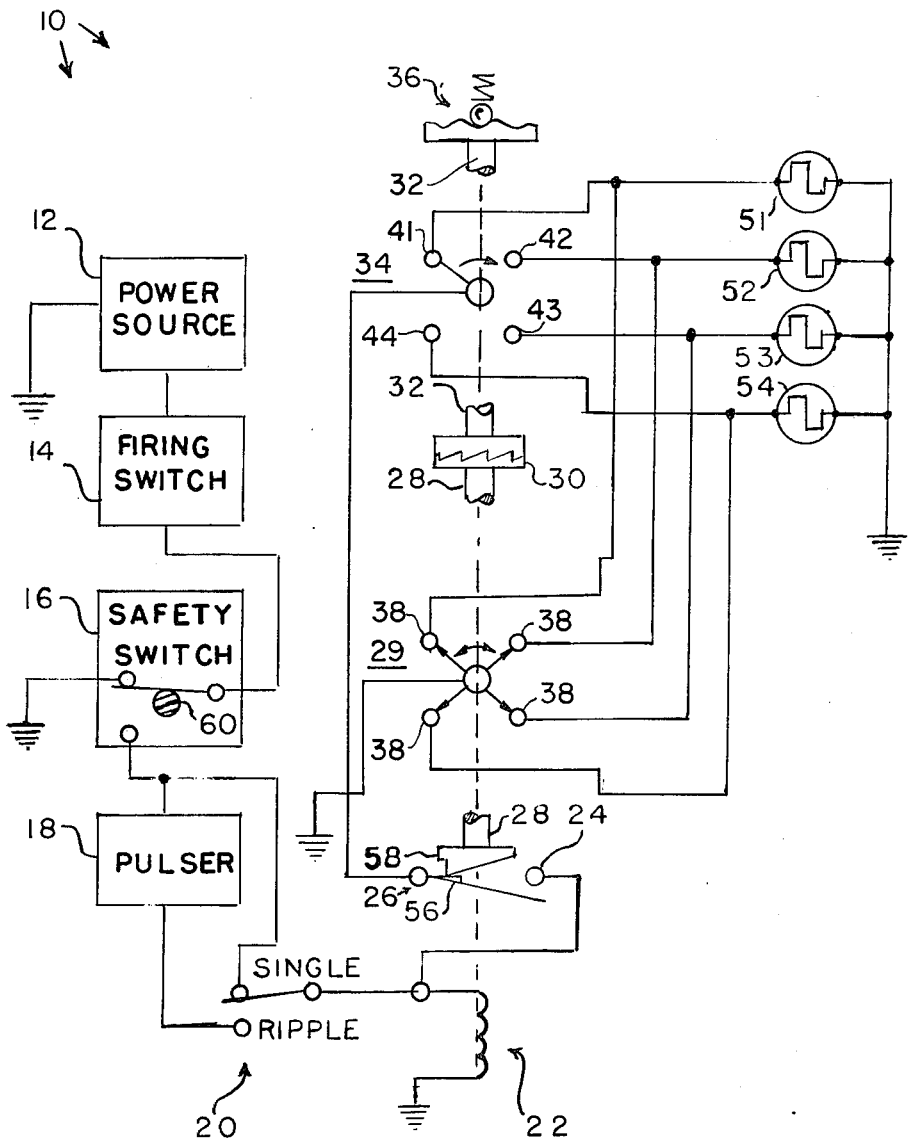
10
36
32
12
POWER SOURCE
41
42
34
51
52
43
44
53
54
32
14
FIRING SWITCH
28
30
16
SAFETY SWITCH
38
38
29
38
60
38
18
PULSER
28
24
58
26
56
SINGLE
RIPPLE
20
22

INTERVALOMETER

CROSS REFERENCE TO RELATED APPLICATIONS

The firing circuit according to the present invention is an improvement in rocket launcher devices as disclosed in Assignee's Prior Application Ser. No. 50,516 filed June 29, 1970, now U.S. Pat. No. 3,719,120 and Assignee's Copending Application Ser. No. 418,623, filed Nov. 23, 1973.

BACKGROUND OF THE INVENTION

The invention pertains to rocket launchers which are used for shipping, storing, and air firing of rockets whereby radiation, static or stray voltage may be encountered which is sufficient to cause premature firing of the rockets therein. To counteract this hazard, many systems have been devised to ground the firing squibs on the rockets until it is time for the rockets to be fired.

Assignee's two prior applications, referenced above, disclose firing circuitry incorporating such safety devices. Although these devices operated satisfactorily for their purpose the search for a system of greater safety goes on.

According to the present invention, all of the rocket firing circuits are grounded through a separate contact in an oscillatory grounding switch which removes the ground only when full current is applied to a solenoid operator. Oscillatory movement of the grounding switch causes step by step rotary motion of the rocket firing switch to apply current serially to the rockets in a predetermined sequence. Current is applied to the firing or stepping switch, however, only during the final instant just as the contacts are closed in the stepping switch. This is accomplished by a spring biased switch which is allowed to close by a cam surface, for example, fixed to the oscillatory switch.

BRIEF DESCRIPTION OF THE DRAWING

The single view of the drawing is basically a schematic diagram of the electrical system with only so much of the switch operating mechanism as necessary for the following description.

DESCRIPTION AND OPERATION

A rocket firing circuit arrangement according to the invention is generally designated by the numeral 10 on the accompanying drawing. The circuit includes a conventional power source 12 and other conventional components such as a firing switch 14 and a safety switch 16. A pulser 18 is provided for ripple firing and is connected through the single/ripple switch 20 to the actuating coil of rotary solenoid 22 and terminal 24 of switch 26.

Energization of solenoid 22 causes limited rotation of shaft 28 against a return biasing means (not shown). Reciprocation of shaft 28 acts through a ratchet member 30 to cause step by step rotation of shaft 32 of a rotary switch 34. Positioning of shaft 32 is accomplished by a ball detent mechanism 36.

Rotary switch 34 has contacts 41, 42, 43 and 44 which are connected respectively to rocket firing squibs 51, 52, 53 and 54 and, in parallel, to contacts 38 of oscillatory switch 29. Although the illustration shows four rocket circuits, it is understood that there could be more or less without departing from the invention.

All of the contacts 38 are connected to ground in the inactive position. As shaft 28 rotates, the contacts 38 open, removing ground from the line side of the rocket firing squibs 51, 52, 53 and 54. When solenoid 22 is de-energized the return biasing means returns shaft 28 to the inactive position, closing contacts 38 and reconnecting ground to the line side of the rocket firing squibs 51, 52, 53 and 54. This results in all rocket firing squibs 51–54 being maintained at ground potential except during the actual firing sequence.

A particular feature of the invention is found in the operation of switch 26 which has a spring contact 56 cooperating with a cam 58 on shaft 28 in such a manner that the switch is not closed until near the end of the travel of oscillatory switch 29 and firing switch 34. At the time that switch 26 is closed, therefore, rotary switch 34 has been advanced to the next contact point. In the illustration shown, therefore, circuit 42 would be the first circuit to be fired.

At all times before the launcher is prepared for flight, the safety switch 16 is held in ground position by a safety pin 60. The single/ripple switch 20 may be of the type manually operated on the launcher or may be solenoid operated from the cockpit of the plane carrying the launcher.

From the foregoing, it may be seen that Applicant has provided a switching system for applying control signals to rocket circuits for either ripple or single firing wherein all the circuits are grounded until an actual activating voltage is applied and then only substantially simultaneously with the making of the final contact with the circuit to be fired.

What is claimed is:

1. In a weapons firing control system wherein a plurality of weapons may be fired by application of electrical current to a plurality of individual firing circuits, the combination comprising:

a source of current;

a firing switch connected to said source;

a solenoid coil connected to said firing switch;

said firing switch operative to supply current to said solenoid coil whereby said coil is energized upon closure of said firing switch;

a multi-position oscillatory solenoid actuated switch having a plurality of contacts and normally biased to an inactive position whereby said oscillatory switch contacts are closed;

said solenoid coil operative, when energized, to move said oscillatory switch to an active position whereby said oscillatory switch contacts are open;

a multi-position rotary switch having a plurality of contacts and operatively connected to said oscillatory switch such that oscillation of said oscillatory switch causes step by step rotation of said rotary switch;

said rotary switch being connected to said source through said firing switch when said solenoid is energized and operative to sequentially supply current to the individual rotary switch contacts;

a plurality of firing circuits each having a line side connected respectively to successive switch contacts in said rotary switch and to individual contacts of said oscillatory switch;

each of said individual contacts of said oscillatory switch being connected to ground when said oscillatory switch is in said inactive position and each of said individual oscillatory switch contacts being disconnected from ground when said oscillatory switch is in said active position;

said oscillatory switch being in said inactive position before and after a weapons firing sequence occurs and operative to maintain all firing circuits at a ground potential before and after said weapons firing sequence.

2. A weapons firing control system as defined in claim 1 further comprising ratchet means between said oscillatory switch and said rotary switch effective to advance said rotary switch one position each time power is supplied to said solenoid.

3. The system of claim 2 including pulser means alternatively connectable to said firing switch for supplying a series of discrete pulses to said solenoid for providing a ripple firing mode.

4. The system of claim 3 including a normally open switch between the firing switch and said rotary switch and means associated with said oscillatory switch for closing said normally open switch substantially at the same time as contact is made with a firing circuit in said rotary switch.

5. The system of claim 2 including a normally open switch between the firing switch and said rotary switch and means associated with said oscillatory switch for closing said normally open switch substantially at the same time as contact is made with a firing circuit in said rotary switch.

6. The system of claim 1 including pulser means alternatively connectable to said firing switch for supplying a series of discrete pulses to said solenoid for providing a ripple firing mode.

7. The system of claim 6 including a normally open switch between the firing switch and said rotary switch and means associated with said oscillatory switch for closing said normally open switch substantially at the same time as contact is made with a firing circuit in said rotary switch.

* * * * *